United States Patent [19]

McGinnis, Gregor E.

[11] Patent Number: 4,653,702

[45] Date of Patent: Mar. 31, 1987

[54] STUNT KITE STRING WINDER

[76] Inventor: McGinnis, Gregor E., 6845 Bristol Dr., Berkeley, Calif. 94705

[21] Appl. No.: 805,951

[22] Filed: Dec. 6, 1985

[51] Int. Cl.[4] ..... B65H 75/40

[52] U.S. Cl. ..... 242/96; 244/155 A

[58] Field of Search ..... 242/96, 100.1; 244/155 A, 155 R

[56] References Cited

U.S. PATENT DOCUMENTS

| | | | |
|---|---|---|---|
| 1,933,163 | 10/1933 | Coplen | 242/96 |
| 2,585,263 | 2/1952 | Miller | 242/100 |
| 3,138,356 | 6/1964 | McClain | 242/96 |
| 3,409,255 | 11/1968 | Sada | 244/155 A |
| 4,065,080 | 12/1977 | Alison | 244/155 A |
| 4,101,090 | 7/1978 | Wait, Jr. | 244/155 A |
| 4,106,719 | 8/1978 | Haverland | 242/96 |
| 4,129,273 | 12/1978 | Hill | 242/96 |
| 4,172,567 | 10/1979 | Post | 242/96 |
| 4,238,086 | 12/1980 | Brimmeier | 242/96 |

*Primary Examiner*—John M. Jillions
*Assistant Examiner*—Katherine Matecki

[57] ABSTRACT

A stunt kite string winding device, including a main shaft rotated manually by means of a crank with two string handles removably attached to the main shaft; the main shaft has a stake end opposite the crank end; the main shaft slides back and forth and rotates through a hole in the main shaft traveler which has an attached string guide.

21 Claims, 18 Drawing Figures

FIG. 1
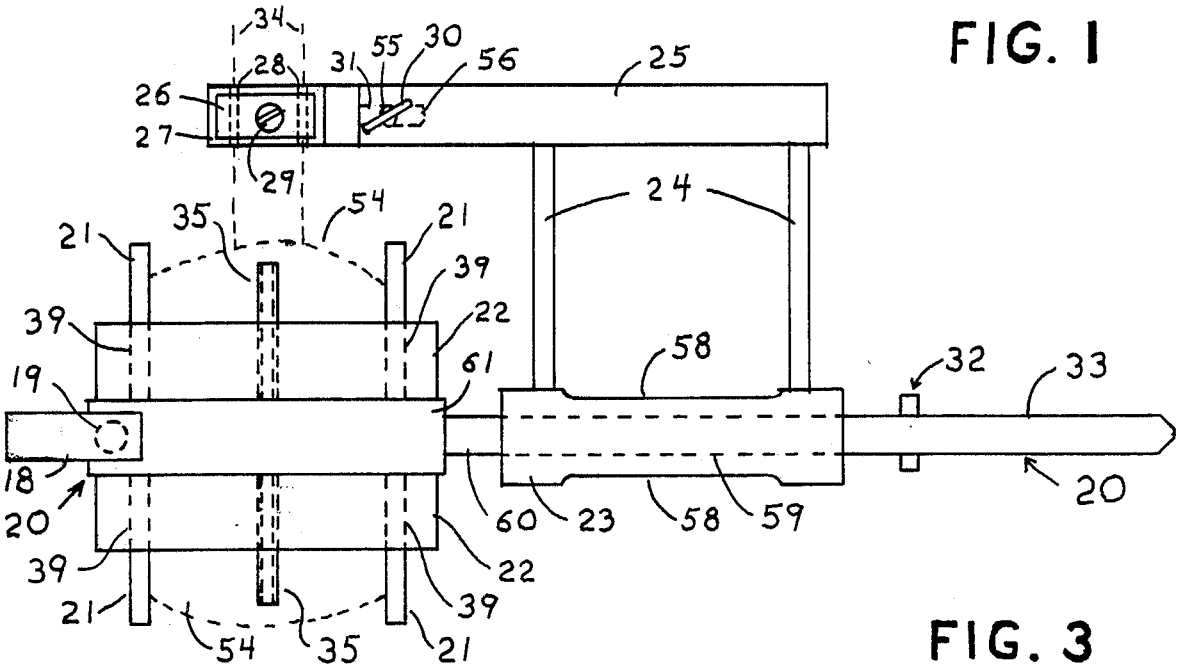
FIG. 3
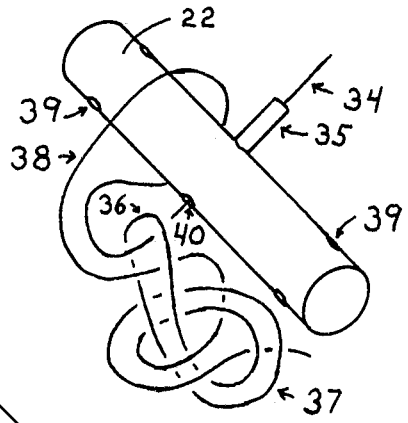
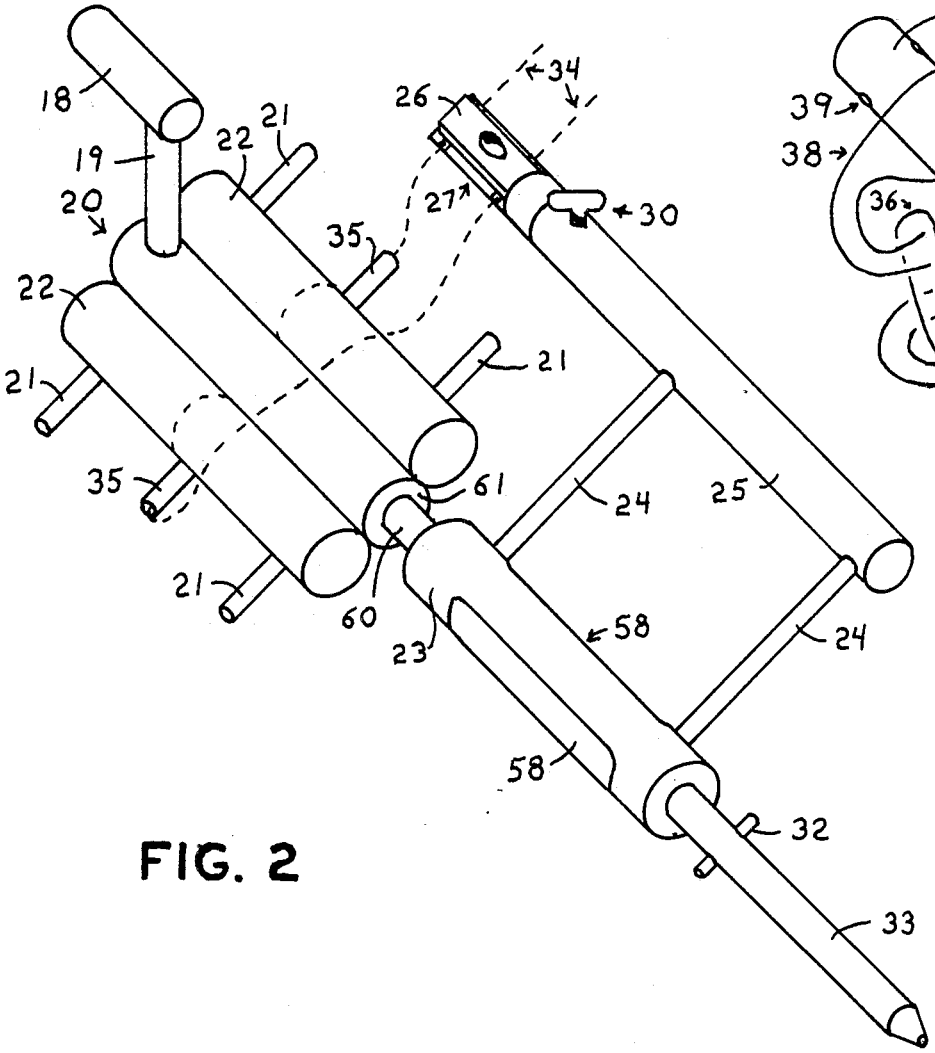
FIG. 2

STUNT KITE STRING WINDER

BACKGROUND OF THE INVENTION

1. Field of the Invention

This invention relates to a kite string winder that can wind up a pair of kite strings so that they do not tangle. It is well known that stunt kites are flown with two fixed lengths of string that are determined before flying. The two strings are laid on the ground and stretched between the string handles and the stunt kite both before and after flight.

2. Description of the Prior Art

Currently there are only two methods of winding these two strings up without entangling them. The first is to wind each of the two strings on its own string handle, one at a time, which is laborious and if not done with care will introduce twist into the kite string.

The second method is to attach the two string handles to a round shaft by some mechanical means so that the string handles lie 180° opposite one another.

The round shaft is twirled or revolved with the thumb and index finger of one hand while the other end of the shaft lays in the crotch of the bent elbow of the opposite arm. The free hand of the bent arm reaches forward and separates the two strings with fingers as the strings are wound in. This method is better than the first but it is awkward and time consuming.

SUMMARY OF THE INVENTION

This invention relates to a kite string winder.

It is the object of this invention to provide a stunt kite string winder that will make it possible to wind up a pair of kite strings simultaneously, quickly and with ease and so they do not entangle.

Another object is to provide kite string handles that have a string guard that will protect the fingers when they hold and grip the string handles.

Another object is to provide a reversible string guide which will make the stunt kite string winder equally easy to use by both right-handed and left-handed individuals.

Another objective is to provide a stake end so that the stunt kite string winder can be secured to the ground, thereby anchoring the string ends when the string handles are attached to the string winder, and allowing the stunt kite to be readied for flight without dragging its kite strings.

BRIEF DESCRIPTION OF DRAWINGS

FIG. 1 is a plan view of the Stunt Kite String Winder.

FIG. 2 is a perspective view of the invention.

FIG. 3 is a perspective view of an embodiment of one string handle and kite string attachment.

DESCRIPTION OF THE EMBODIMENT

Figure 4:
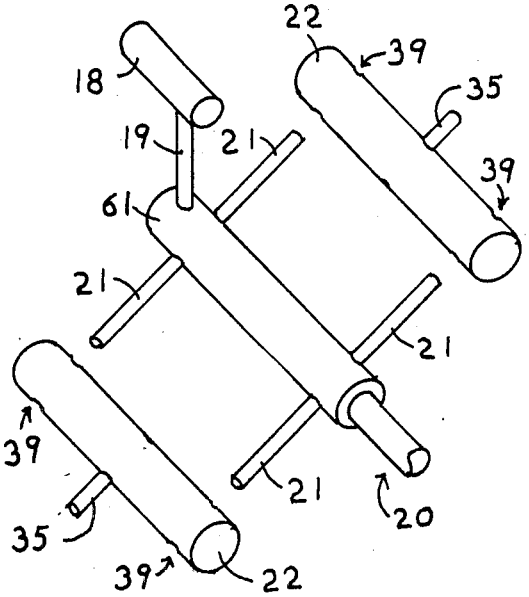
FIG. 4 is a perspective view of an embodiment for attaching string handles to the main shaft.

Referring now the drawings in greater detail and more particularly to FIGS. 1 and 2, the Stunt Kite String Winder comprises a main shaft 20 with two string handles 22 removably attached. The string handles are rotatably supported in a bearing hole 59 through the main shaft traveler 23 with rigidly attached string guide support member 25.

The main shaft 20 is made of a rigid material and includes a string handle rest 61 that is of a larger diameter than the main shaft traveler track 60 and stake end 33 and is turned round so as to rotate within the central longitudinal cylindrical bearing hole 59 of the main shaft traveler 23. At the string handle rest end 61 is a crank 19 and crank handle 18.

As seen in FIGS. 1, 2 and 4, the configuration shows that the string handle rest 61 is attached to four retaining pins 21 which are located in two pairs so that each are 180° and opposite to one another and the retaining pins 21 are spaced at such a distance apart along the string handle rest 61 to align with parallel holes 39 near the ends of the string handles 22 so that the string handles 22 can be slid over the retaining pins 21 and be secured to the string handle rest 61 by a tight sliding fit.

The main shaft traveler 23 is made of a rigid material and supports by means of the support arms 24 the string guide support member 25 which supports the string guide 27. The main shaft traveler 23 is a longitudinal cylindrical member with two flat surfaces 58, one hundred and eighty degrees (180°) and opposite one another and extending between support arms 24 so as to aid in the holding and prevention of rotation of the main shaft traveler 23 by the user's gripping hand. The main shaft 20 rotates in and slides back and forth through the bearing hole 59 in the main shaft traveler 23 on the main shaft traveler track 60 which is slightly less long than the distance between a pair of string handle retaining pins 21. The extremes of the main shaft traveler track 60 are the string handle rest 61 and the traveler stop 32, a rigid pin protruding perpendicularly from the main shaft 20. The main shaft traveler 23, by means of two parallel support arms of equal length, one attached near each end, radiate out supporting the string guide support member 25 rigidly and at a distance that provides adequate clearance for wound-in string build up 54 and string handle pins 21.

The string guide support member 25 is a rigid longitudinal member that supports the string guide 27.

Figure 9:
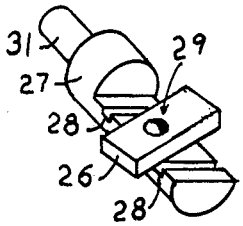
FIG. 9 is a perspective view of the alternative construction for the string guide and string retainer.

In this configuration, which is detailed in FIG. 9, the string guide 27 consists of a member with one flat surface which has two string grooves 28 of a depth and a width that will allow kite string 34 to easily pass through. The string retainer 26 is a member with one flat surface that engages the flat surface of the string guide 27 by means of a string retainer screw 29 which is screwed into the string guide 27 between the two string grooves 28 so as to provide moderate sliding friction. The string retainer 26 is narrow enough to leave the string grooves 28 open when twisted across the string guide and parallel to the string grooves 28 and long enough to close the string grooves 28 when twisted ninety degrees (90° ). Also in this configuration the string guide 27 can rotate axially about a string guide pin 31, a short cylindrical shaft protruding centrally and longitudinally from the string guide end and is engaged in a hole 56, (see FIG. 16) that is longitudinal and centered in the end of the string guide support member 25 and is so deep as to accept the length of the string guide pin 31. A threaded hole 55 intersects the string guide pin hole 56 at right angles which accepts a thumb screw 30 that allows rotationability of the string guide 27 when thumb screw 30 is loosened and a means to secure the string guide 27 when tightened. This provision for rotating the string guide one hundred and eighty degrees (180° ) is necessary so that the string grooves 28 face up, aiding in the placement of kite strings 34 in the string grooves 28 before they are secured by the string retainer 26. It is apparent that this provision is necessary for the stunt kite string winder to be used with equal ease by both right-handed and left-handed individuals.

The string guide support member 25 is so long as to support the string guide 27 in such a way that when the main shaft traveler 23 is at the central point of the main shaft traveler track 60 the string grooves 28 of the string guide 27 are centered axially between the string handle retaining pins 21. The kite strings 34 are wound up evenly across the string handles 22 by holding the main shaft traveler 23 so the string guide 27 is in front and the string grooves lie in the direction of the kite strings 34 while the crank handle 18 is rotated with an in and out motion parallel to the main shaft 20.

In this configuration the main shaft 20 continues past the traveler stop 32 to a stake end 33 which is a pointed length adequate to secure the stunt kite string winder upright in the ground. This enables the kite flyer to secure the string handles 22 up wind while he or she readies their kite for flight.

The drawing in FIG. 3 is one possible embodiment of the string handle 22 which has a hole 40 in its center to accommodate the flexible tubing finger guard 35 which serves to protect the fingers that hold and grip the string handle 22. The kite string 34 is fastened to the string handle 22 by means of a loop 36 in the end of the overhand knot 37 through which a second formed loop 38 is made to encircle the diameter of the string handle 22 where it is pulled tight by the free end of the kite string 34. Other embodiments of the string handle 22 can include the central hole 40 and flexible tubing figure guard 35 without the string handle holes 39 to accept handle retaining pins 21 for use with the other embodiments of handle retainers as shown in FIGS. 5, 6, and 7.

Figure 5:
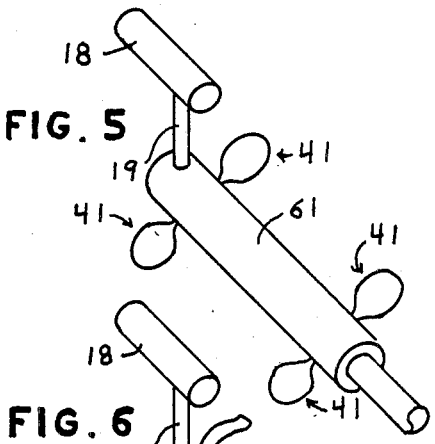
FIG. 5 is a perspective view of alternative construction for attaching string handles to the main shaft.

In FIG. 5 is the flexible stretch cord string handle retainers 41 which consist of flexible stretch cord that form four loops so that they form two pairs each, each located one hundred and eighty degrees (180° ) and opposite to one another on the circumference of the string handle rest 61 and the loops of the pairs spaced at such a distance apart along the string handle rest 61 to accommodate the diameter of the string handles 22 near their ends.

Figure 6:
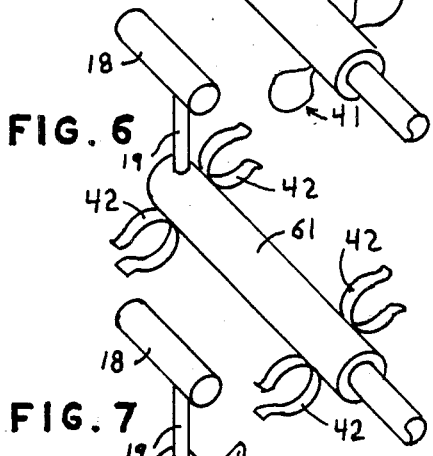
FIG. 6 is a perspective view of another alternative construction for attaching string handles to the main shaft.

In FIG. 6 is shown the side clamp string handle retainers 42 that consist of holding devices that are made "U" shaped from a semi-rigid material, such as plastic or sheet metal, to provide a snap friction fit to the string handles sides towards their ends and to secure the string handle 22 on the string handle rest (61) at one hundred and eighty degrees (180° ) and opposite to one another.

Figure 7:
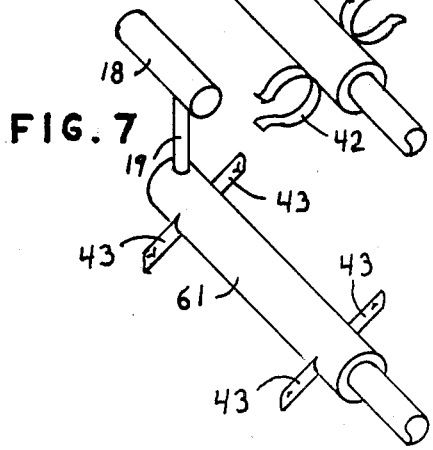
FIG. 7 is a perspective view yet another alternative construction for attaching string handles to the main shaft.

In FIG. 7 is shown the end clamp string handle retainers 43 that consist of holding devices made from a semi-rigid material such as plastic and sheet metal and placed so that they form two pairs, one hundred and eighty degrees (180° ) and opposite to each other on the string handle rest 61, and the holding devices of each pair spaced at such a distance apart along the string handle rest 61 so that the string handles 22 will fit in between lengthwise with a snap friction fit at the end clamp grip points 44.

All the different means for securing the string handles 22 to the string handle rest 61, represented in FIGS. 4, 5, 6, and 7, provide a means to allow easy attachment and removal of the string handles.

Figure 8:
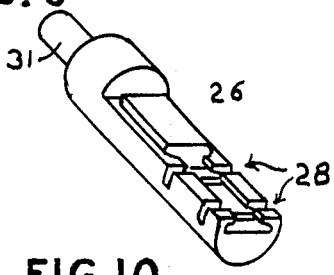
FIG. 8 is a perspective view and detail of an embodiment for the string guide and string retainer.

In FIGS. 8, 10, 11, 12, and 13 are shown different embodiments of the string guide 27 and string retainer 26. In FIG. 8 is shown an embodiment of a string guide 27 in which the string retainer 26 slides lengthwise in formed interior grooves 49 in the string guide 27. The formed interior grooves 49 are of such a length to allow the string retainer 26, when positioned toward the string guide pin 31, to clear the string grooves 28 and the string guide retainer 26 is long enough to cover both string grooves 28 simultaneously when positioned over the string grooves 28.

Figure 10:
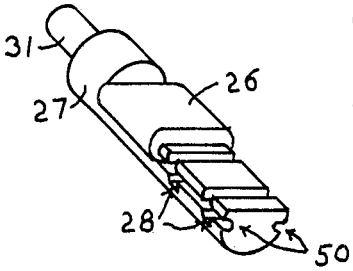
FIG. 10 is a perspective view of another alternative construction for the string guide and string retainer.

In FIG. 10 is shown an embodiment that differs from that shown in FIG. 8 in that the string retainer 26 travels in formed exterior grooves 50.

Figure 11:
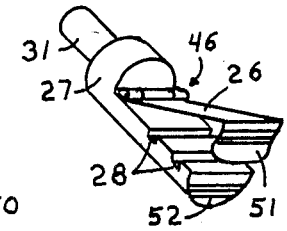
FIG. 11 is a perspective view of yet another alternative construction for the string guide and string retainer.

In FIG. 11 is shown an embodiment of a string guide 27 in which the string retainer 26 is hinged near the string guide pin 31 and by the string retainer hinge 46, the string retainer is a length that allows covering the string grooves 28 when folded down and reaches the free end of the string guide 27 that is formed to make a recess 52 so that the end of the string retainer 26 which is forged to match the recess 52 will snap down and over it.

Figure 13:
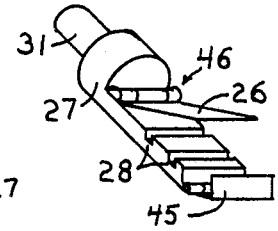
FIG. 13 is a perspective view of and still yet another alternative construction of the string guide and string retainer.

In FIG. 13 is shown an embodiment that differs from the string retainer 26 shown in FIG. 11 in that the free end of the string retainer 26 that is hinged, is secured by a different means which is an "L" shaped retaining clip 45 hinged at the free end of the string retainer 27 in such a manner that when the string retainer 26 is folded down to the surface in which the string grooves 28 are formed, the free end of the "L" shaped retainer clip 45 can be positioned over and secure the string retainer 26.

Figure 12:
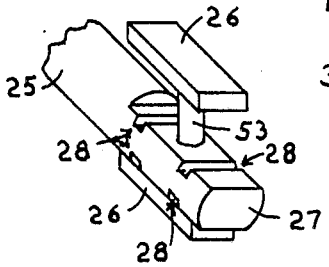
FIG. 12 is a perspective view of still yet another alternative construction for the string guide and string retainer.

In FIG. 12 is shown an embodiment of the string guide 27 in which the string retainer 26 consists of two identical attached members that each have one flat surface long enough to cover both string grooves 28 simultaneously. At the center point on each flat surface the two attached members are connected to each other by a connecting member 53 that slides in a hole located between the string grooves 28 and across the diameter perpendicular to the flat surface of the string guide 27. The hole in which the connecting member slides is to provide a sliding friction fit. The connecting member 53 is to be long enough so that when the attached member at one end is positioned to be in contact with its mating surface the opposite attached member is raised clear of its mating surface to create enough clearance to insert kite strings 34 into string grooves 28. In this embodiment the string guide 27 has two pairs of string grooves 28 located one hundred and eighty degrees (180° ) and opposite one another. The connection between the string guide 27 and the string guide support member 25 is rigid.

Figure 14:
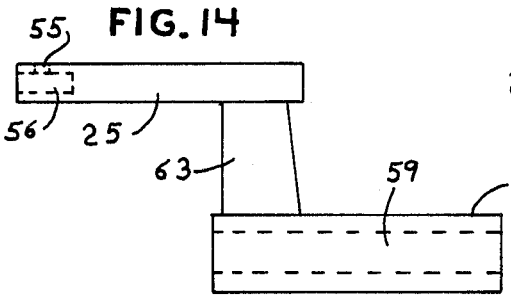
FIG. 14 is a side view of another construction for the connection of the string guide traveler to the string guide support member.
Figure 15:
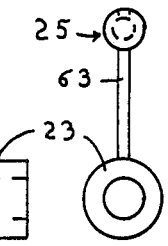
FIG. 15 is an end view of FIG. 14.

In FIGS. 14 and 15 is shown an embodiment of a single support arm 63 connection between the main shaft traveler 23 and the string guide support member 25 which is a solid, thin web-like structure that supports the string guide support member 25 parallel to the main shaft 20 and at a distance that provides adequate clearance for wound in string build up 54 and string handle retaining pins 21.

Figure 16:
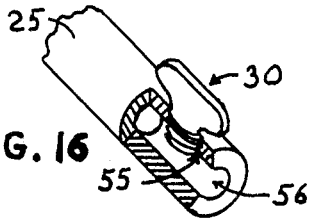
FIG. 16 is a perspective view and detail of contruction for the connection between the string guide and string guide support member.
Figure 17:
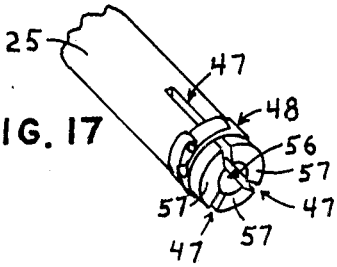
FIG. 17 is a perspective view of an alternative construction between the string guide and the string guide support member.

In FIG. 17 is shown an embodiment of a string guide pin hole 56 that differs from that shown in FIG. 16 in that radial slots 47 are cut to the depth of the string guide pin hole 56 forming fingers that compress inward by a quick release compression clamp 48.

Figure 18:
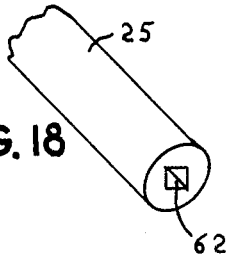
FIG. 18 is a perspective view of another alternative construction between the string guide and the string guide support member.

In FIG. 18 is shown an embodiment of a string guide pin hole 62 that is square to accommodate a string guide pin 31 that is square and that provides a tight removable fit. This is an alternate means to provide one hundred and eighty degrees (180° ) relocation of the string guide by pulling the string guide 27 out of the square hole 62 rotating one hundred and eighty degrees (180° ) and reinserting back on square hole 62.

The foregoing is considered as illustrative only of the principles of the invention. Further, numerous modifications and changes will readily occur to those skilled in the art. It is not desired to limit the invention to the exact construction and operation shown and described, and accordingly, all suitable modifications and equivalents may be resorted to, falling within the scope of the invention as claimed.

What I now claim is:

1. A string winder for stunt kites, comprising in combination a main shaft and a main shaft traveler rotatably and slidably mounted on the main shaft, a string guide mounted to the main shaft traveler and located radially outwardly of a winding portion of said main shaft and including a plurality of passages therethrough, a pair of cylindrical string handles each having a kite string attached thereto, and means for releasably attaching the handles to the shaft at said winding portion and parallel thereto; wherein the kite strings are wound about both handles and the shaft when the kite strings are passed through the string guide passages and the main shaft is rotated relative to the main shaft traveler, and the handles are detached from the main shaft for operating a stunt kite.

2. The string winder of claim 1, further comprising a hollow flexible tube of plastic or rubber that protrudes radially from said string handles at their centers, said kite string passing one each through the said hollow flexible tubing whereby said hollow flexible tubing prevents said kite string from contacting a kite flier a kite flier's gripping fingers.

3. The string winder of claim 1, wherein the means for releasably attaching sid string handles consist of two pairs of retaining pins radially attached to said main shaft that slidably engage parallel through holes across the diameter of said string handles near their ends.

4. The string winder in claim 1, wherein the means for releasably attaching said string handles consist of two pairs of "U" shaped clamps radially attached to said main shaft that slidably engage said string handles near their ends.

5. The string winder it claim 1, wherein the means for releasably attaching said string handles consist of two pairs of end clamps radially attached to said main shaft that slidably engage said string handles at their ends.

6. The string winder in claim 1, wherein the means for releasably attaching said string handles consist of two pairs of flexible stretch cord loops radially attached to said main shaft that stretch and receive said string handles near their ends.

7. The string winder in claim 1, wherein the string guide passages comprise two string grooves in the string guide perpendicular to said main shaft and of a depth and width that will permit free passage of said kite strings.

8. The string winder of claim 7, wherein said string guide includes string retainer means comprising an elongated member rotatably mounted on the string guide at a point between the string grooves, the elongated member being rotated to cover or uncover the string grooves.

9. The string winder of claim 7, wherein said string guide includes string retainer means comprising an elongated member slidably mounted on the string guide to slide axially therealong between a groove-covering and a groove-uncovering position.

10. The string winder of claim 7, wherein said string guide includes string retainer means comprising an elongated member hingedly mounted to the string guide at one end thereof, the elongated member pivoting between a covering position parallel to the string guide to cover the grooves, and an uncovering position remote from the grooves.

11. The string winder of claim 1, wherein the string guide passages comprise two sets of two string grooves located on opposite sides of the string guide, either set of grooves being selectively covered and uncovered by an "H" shaped retainer slidably mounted between the two grooves of each set.

12. The string guide of claim 1, wherein the string guide is affixed to a string guide support member mounted on said main shaft traveler.

13. The string winder of claim 12, wherein said string guide support member includes a longitudinal hole parallel to the main shaft at one end.

14. The string winder of claim 12, wherein the string guide is rotationally adjustably secured to the said string guide support member by means of a threaded thumb screw that engages the string guide pin through a threaded hole in the said string guide support member.

15. The string winder of claim 12, wherein the string guide includes a string guide pin for insertion in said longitudinal hole in said string guide support member.

16. The string winder of claim 15, wherein the string guide is rotationally adjustably secured to the said string guide support member by means of a lever activated clamp and axially extending fingers at the end of said string guide support member which are compressed by said clamp to engage said string guide pin.

17. The string winder of claim 14, wherein the string guide pin is square in cross-section and received in a square hole in the string guide support member whereby said string guide can be withdrawn, turned over and then reinserted.

18. The string winder of claim 1, comprising main shaft traveler stops fixed on the main shaft, whereby the main shaft traveler's axial movement is restricted to an amount equal to the width of said winding portion of the main shaft.

19. The string winder of claim 1, including a crank handle attached to said main shaft at an end nearest the string handle attachment means.

20. The string winder of claim 1, wherein the crank handle, said string handles, and said main shaft traveler are covered with a resilient material such as foam rubber or foam plastic.

21. The string winder of claim 1, wherein the main shaft has a stake end comprising an elongated extension ending in a pointed taper.

* * * * *